US005962843A

United States Patent [19]

Sinor et al.

[11] Patent Number: 5,962,843

[45] Date of Patent: Oct. 5, 1999

[54] NIGHT VISION HAVING AN IMAGE INTENSIFIER TUBE, IMPROVED TRANSMISSION MODE PHOTOCATHODE FOR SUCH A DEVICE, AND METHOD OF MAKING

[76] Inventors: Timothy Wayne Sinor, 3836 Pine Valley Dr., Plano, Tex. 75025; Joseph Paul Estrera, 7525 Holly Hill, #35, Dallas, Tex. 75231

[21] Appl. No.: 08/895,917

[22] Filed: Jul. 17, 1997

[51] Int. Cl.[6] ..... H01J 40/14

[52] U.S. Cl. ..... 250/214 VT; 313/524; 437/5

[58] Field of Search ..... 250/207, 214 VT; 313/103 CM, 105 CM, 524–528, 532; 437/5

[56] References Cited

U.S. PATENT DOCUMENTS

| | | | |
|---|---|---|---|
| 3,814,996 | 6/1974 | Enstrom et al. . | |
| 4,286,373 | 9/1981 | Gutierrez et al. . | |
| 4,477,294 | 10/1984 | Gutierrez et al. . | |
| 4,498,225 | 2/1985 | Gutierrez et al. . | |
| 5,268,570 | 12/1993 | Kim | 250/214 VT |
| 5,378,640 | 1/1995 | Kim | 437/5 |
| 5,506,402 | 4/1996 | Estrera et al. | 250/214 VT |
| 5,610,078 | 3/1997 | Estrera et al. | 437/5 |

FOREIGN PATENT DOCUMENTS

| | | |
|---|---|---|
| 1478453 | 6/1973 | United Kingdom . |

*Primary Examiner*—Stephone Allen
*Attorney, Agent, or Firm*—Terry L. Miller

[57] ABSTRACT

A night vision device includes an image intensifier tube, which includes a photocathode responsive both to white light and to infrared light to release photoelectrons. The photocathode is particularly sensitive to infrared light at the 980 nm wavelength, and has desirable spectral response characteristics.

30 Claims, 2 Drawing Sheets

NIGHT VISION HAVING AN IMAGE INTENSIFIER TUBE, IMPROVED TRANSMISSION MODE PHOTOCATHODE FOR SUCH A DEVICE, AND METHOD OF MAKING

BACKGROUND OF THE INVENTION

1. Field of the Invention

This invention is in the field of night vision devices which provide a visible image from low-level visible light or from light in the near-infrared (invisible) portion of the spectrum by use of an image intensifier tube. As used herein, the term "light" means electromagnetic radiation, regardless of whether or not this light is visible to the human eye.

Image intensifier tubes of such night vision devices generally include a photocathodes which is responsive to light in the infrared spectral range to release photoelectrons. Thus, the present invention is also in the field of such photocathodes. The photoelectrons released within such an image intensifier tube may be amplified or multiplied by conventional devices such as a microchannel plate or dynode to provide, for example, a current indicative of a light flux, or to produce an image of a light source or of an object illuminated with infrared light.

The present photocathode includes an active layer of indium gallium arsenide (InGaAs).

2. Related Technology

Night vision devices which use an image intensifier tube are well known. Generally, such devices include an objective lens by which light from a distant scene is received and focused upon a photocathode of the image intensifier tube. A power supply of the device provides appropriate voltage levels to various connections of the image intensifier tube so that this tube responsively provides a visible image. An eyepiece lens of the device provides the visible image to a user of the device.

Particularly, the image intensifier tube includes a photocathode responsive to light photons within a certain band of wavelengths to liberate photoelectrons. Because the photons are focused on the photocathode in a pattern replicating an image of a scene, the photoelectrons are liberated from the photocathode in shower having a pattern replicating this image of the scene. Within the image intensifier tube, the photoelectrons are moved by an applied electrostatic field to a microchannel plate, which includes a great multitude of microchannels. Each of the microchannels is effectively a dynode, which liberates secondary emission electrons in response to photoelectrons liberated at the photocathode. The shower of secondary emission electrons from the microchannel plate are moved to a phosphorescent screen which provides a visible image in yellow-green phosphorescent light.

Conventional photocathodes are disclosed in each of the following United States or foreign patents:

U.S. Pat. No. 3,814,996, issued Jun. 4, 1974, is believed to disclose a photocathode of an ternary alloy of indium, gallium, and arsenide of the formula $In_xGa_{1-x}As$, in which "x" has a value of from 0.15 to 0.21.

U.S. Pat. No. 4,286,373, issued Sep. 1, 1981, is believed to disclose a photocathode of gallium arsenide at the photo-emitting layer, and is associated with a layer of gallium, aluminum, arsenide as a passivating layer.

U.S. Pat. No. 4,477,294, issued Oct. 16, 1984, is believed to relate to a photocathode of gallium arsenide as the photo-emitting layer, which is formed by hybrid epitaxy.

U.S. Pat. No. 4,498,225, issued Feb. 12, 1985, is thought to disclose a photocathode of gallium arsenide, formed on a glass substrate with intervening layers of gallium, aluminum, arsenide as passivation and anti-reflection layers.

U.S. Pat. No. 5,268,570, relates to a photocathode of indium gallium arsenide, grown on an aluminum indium arsenide window layer.

Similarly, U.S. Pat. No. 5,506,402, relates to a photocathode of indium gallium arsenide, grown on an aluminum gallium arsenide window layer.

British patent No. 1,478,453, issued Jun. 29, 1977, is believed to disclose a photocathode comprising $(Ga_{1-x}\ Al_x)_{1-z}In_zAs$, wherein $(0 \leqq z < y)$ It appears that none of these conventional photocathodes are optimized to provide imaging at wavelengths above 950 nm. Such imaging is desired in order to allow active illumination of a scene with a laser. Conventional GaAs photocathodes have a long-wavelength cutoff of about 900 nm. The cutoff wavelength can be extended to the range of 900–1100 nm by using a ternary compound of indium, gallium, and arsenide. While the quantum efficiency of such photocathodes is less than conventional GaAs photocathodes, the greater photon availability under night-sight conditions compensates for this loss of efficiency. The photon activity of the night sky in the 800–900 nm band is five to seven times as great as in the visible region. Conventional photocathodes of the InGaAs type have a white-light response of about 300$\mu$/lm, with a radiant response at 1060 nm of about 0.025 mA/W.

A photocathode which achieves a white-light sensitivity of 500$\mu$/lm while maintaining a radiant response of greater than 30 mA/W to light of 980 nm wavelength is desirable.

SUMMARY OF THE INVENTION

In view of the deficiencies of the related technology, a primary object for this invention is to avoid one or more of these deficiencies A further object for this invention is to provide a photocathode having an spectral response optimized at the 980 nm wavelength.

Another objective for this invention is to provide an image intensifier tube having such a photocathode, Yet another object for this invention is to provide a night vision device including an image intensifier tube having such a photocathode.

A particular objective for this invention is to provide a photocathode which achieves a white-light sensitivity of about 500$\mu$/lm while maintaining a radiant response of greater than about 30 mA/W to light of 980 nm wavelength.

Accordingly the present invention provides according to one aspect, a photocathode for receiving photons of light and responsively emitting photoelectrons and being optimized for a quantum response level to light having a wavelength of substantially 980 nm, the photocathode comprising: a face plate; a window layer; an active layer of indium gallium arsenide (InGaAs), in which the percentage of indium compared to the total of indium and gallium together in the active layer is in the range from about 9.5% to about 15%.

According to another aspect, the present invention provides a method of making a photocathode which is responsive to photons of infrared light to emit photoelectrons, said method comprising the steps of: providing a face plate; providing a window layer on the face plate; attaching an active layer of indium gallium arsenide on the window layer; and providing the active layer with a percentage of indium of substantially 12 to 13 percent in comparison to the total of indium and gallium in the active layer.

An advantage of the present photocathode and image intensifier tubes and night vision devices including such image intensifier tubes is that the advantageously high quantum response of the photocathode to light having a wavelength of about 980 nm makes possible imaging with laser light of this wavelength, as well as sighting by use of a laser beam having this wavelength (i.e., laser designation). Thus, a user of such a night vision device can see dimly illuminated scenes by use of infrared which is richly present in the night time sky. Further, the user can, if necessary, further illuminate an object in such a scene with a laser having this wavelength and can see the object so illuminated. That is, the user can see a designator laser spot of this wavelength when such a spot is projected onto an object in the field of view of the night vision device.

These and additional objects and advantages of the present invention will be apparent from a reading of the following detailed description of a preferred exemplary embodiment of the invention taken in conjunction with the appended drawing Figures. In the appended drawing Figures the same features, or features which are analogous in structure or function, are indicated with the same reference numeral.

BRIEF DESCRIPTION OF THE DRAWINGS FIGURES

FIG. 1 provides a diagrammatic cross sectional view of a night vision device;

FIG. 2 provides a cross sectional view of an image intensifier tube which may be used in a night vision device,, and which may include a photocathode according to this invention;

FIG. 3 is a cross sectional view of a photocathode assembly for use in an image intensifier tube;

FIG. 4 provides a graph showing a typical spectral response of photoelectron emission for a photocathode embodying the invention as a function of wavelength of incident light and also includes a comparison graph of a conventional GEN III photocathode;

FIG. 5 provides a diagrammatic cross sectional view of a manufacturing intermediate product which is used to make a photocathode as seen in FIG. 3 and which also illustrates steps in the method of making such a photocathode.

DETAILED DESCRIPTION OF A PREFERRED EXEMPLARY EMBODIMENT OF THE INVENTION

Figure 1:
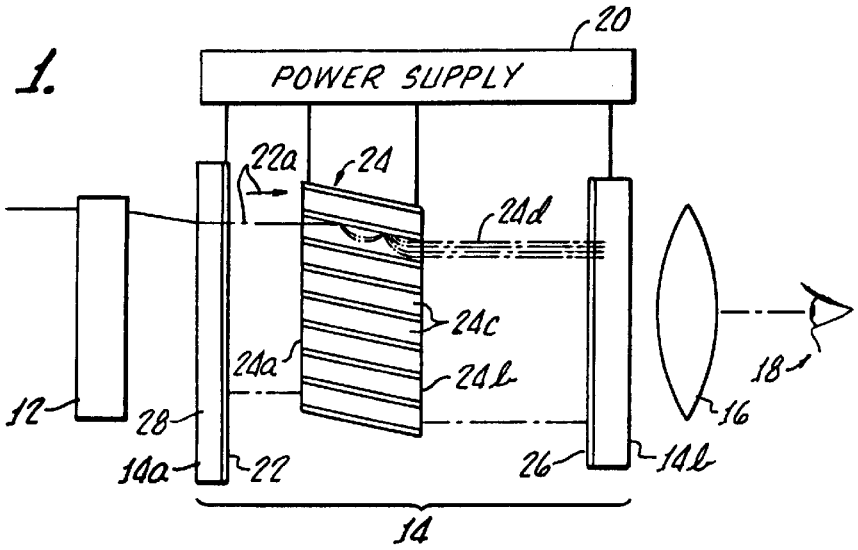

The following is a description of a single exemplary preferred embodiment of the present invention, and as such is not to be taken as limiting or exhaustive of all possible embodiments of the invention, nor indicative of the entire and complete scope of the invention to the exclusion of all other possible embodiments. Other possible embodiments of the present invention will certainly suggest themselves to those ordinarily skilled in the pertinent arts, and will be recognized as being within the scope of this invention. Accordingly, the invention is to be seen as being limited and defined only by the spirit and scope of the appended claims, giving cognizance to equivalents in structure and function in all respects Viewing the appended drawing Figures in conjunction with one another, and viewing first FIG. 1, an exemplary and highly diagrammatic night vision device 10 is illustrated This night vision device 10 includes an objective lens 12 focusing light 12*a* from a distant scene through an input window 14*a* of an image intensifier tube 14. It will be understood that although a single objective lens 12 is illustrated, the night vision device 10 may include more than one lens providing an objective for the image intensifier tube 14. The image intensifier tube 14 includes an output window 14*b* at which a visible image is provided. This visible image is provided by an eyepiece lens 16 to a user 18. Again, the eyepiece 18 may include more than one lens. A power supply 20 including a battery 20*a,* provides power over connections 20*b* for operation of the image intensifier tube 14.

Figure 2:
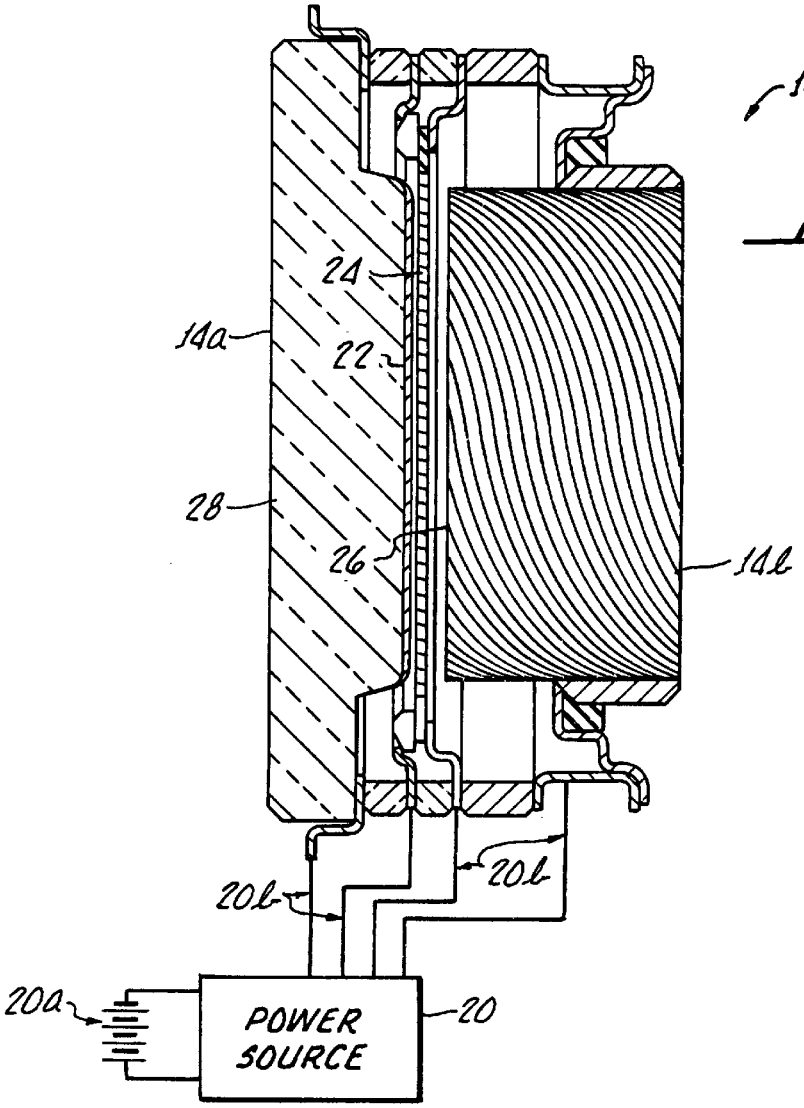

Considered more particularly, the image intensifier tube 14 is seen in FIG. 2 to include a photocathode 22 which is carried by the input window 14*a,* and upon which the light is focused by objective lens 12. This photocathode 22 responsively liberates photoelectrons, indicated by arrows 22*a,* in a pattern replicating the image focused on this photocathode. The photoelectrons 22*a* are moved by a prevailing electrostatic field maintained by power supply 20 to a microchannel plate 24 having opposite faces 24*a* and 24*b*. Face 24*a* is an input face, while face 24*b* is an output face, as will be seen. Extending between the opposite faces 24*a* and 24*b* is a great multitude of microchannels, indicated generally be arrowed numeral 24*c*. These microchannels have an inner surface formed of a material which is an emitter of secondary electrons, so that each microchannel is individually a dynode. The photoelectrons from photocathode 22 thus enter the microchannels 24*c* and cause the emission of a correspondingly greater number of secondary emission electrons.

As a result, a great number of secondary emission electrons (indicated by arrows 24*d*) still in a pattern replicating the image focused on photocathode 22, is released by the microchannel plate 24. This shower of secondary emission electrons travels under the influence of another electrostatic field to an output electrode 26. The output electrode 26 may take a variety of forms, but preferably includes an aluminized phosphorescent screen coating, indicated with arrowed numeral 26*a*. This phosphorescent screen may be carried by the output window 14*b*. Also, in response to the shower of secondary emission electrons the phosphorescent screen produces a visible image in response to the shower of secondary emission electrons, and this image is transmitted out of the tube 14 via the output window 14*b*.

Photocathode 22 in overview (now particularly viewing FIG. 3) includes a transparent and supportive face plate portion 28, which in this instance will form the input window 14*a* of the image intensifier tube 14 when this face plate is joined with other parts of the tube 14 to become a part of the tube. As will be seen, the face plate portion 28 serves to support active portions of the photocathode 22, to transmit photons of light to the active portions of the photocathode 22, and to sealingly close a vacuum envelope of the image intensifier tube 14. Preferably, the face plate portion 28 is formed of glass, such as Corning 7056 glass. This Corning 7056 glass may be used advantageously as the face plate portion 28 because its coefficient of thermal expansion closely matches that of other portions of the photocathode 22. Alternatively, other materials may be used for the face plate portion 28. For example, single-crystalline sapphire ($Al_2O_3$) might be used as the material for face plate portion 28. Thus, the present invention is not limited to user of any particular material for face plate portion 28.

Supported by the face plate portion 28 are the active portions of the photocathode 22, collectively generally indicated with the numeral 30. These active portions are configured as successive layers, each cooperating with the whole of the photocathode structure 22 to achieve the objects of this invention. More particularly, adjacent to the face plate 28 is an anti-reflection (and thermal bonding) coating 32 of silicon nitride and silicon dioxide. Upon this layer 32 is carried a window layer 34. In this case, the window layer 34 is most preferably made of aluminum gallium arsenide (AlGaAs).

As will be further discussed below, the window layer 34 serves to provide a structural transition between the glass face plate 28 and the crystalline structure of an active layer carried on the window layer 34. Additionally, the window layer serves as a potential barrier effectively "reflecting" thermalized electrons in the active layer back toward a crystal-vacuum interface at which photoelectrons are released into the image intensifier tube.

An active layer 36 is carried on window layer 34, and is responsive to photon of light to release photoelectrons (recalling arrows 22*a*) Preferably, the active layer 36 is formed of the ternary compound indium gallium arsenide (InGaAs), having the formula $In_xGa_{1-x}As$. This active layer 36 is conventionally activated to achieve negative electron affinity, and thus includes activation atoms of cesium and oxygen (indicated with the arrowed numeral 38). An electrode 40 is formed in the shape of a band or collar circumscribing the photocathode assembly 30, and providing electrical connection from power supply 20 in the completed image intensifier tube 14 to the active layer 36, recalling connections 20*b* seen in FIG. 1 Preferably, the electrode 40 is formed of chrome/gold alloy having advantages in the vacuum furnace brazing operation which is used to sealingly unite the components of tube 14, as those who are ordinarily skilled in the pertinent arts will understand In other words, the photocathode assembly 22 seen in FIG. 3 will be sealingly united with other components of the tube 14 of FIG. 3 to form a vacuum envelope within which photoelectrons and secondary emission electrons may freely move.

In order to optimize both white-light and 980 nm sensitivity of the photocathode 22, preferably the band gap of the active material of layer 36 is selected to be approximately equal to the quantum energy level of 980 nm light. Particularly, the band gap is selected to be about equal to the quantum energy of 1265 eV for 980 nm light. Determining the band gap energy of InGaAs material as a function of the indium constituent may be accomplished by use of the following equation: equation:

$$Eg(X)=0.36+0.79x+0.28x^2$$

Solving the above equation for (x) gives a result of x=12.55% This percentage of indium in the InGaAs active layer of a photocathode may be considered to be an analytical optimum level, but is an optimum level which need not be achieved precisely in order to realize the benefits and objectives of this invention.

Figure 3:
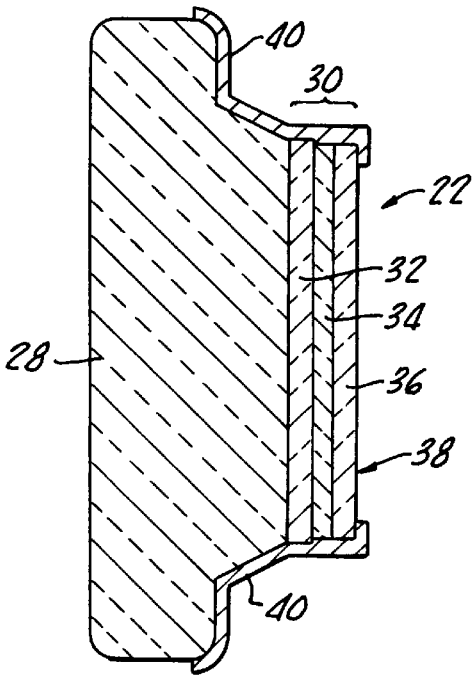
Figure 5:
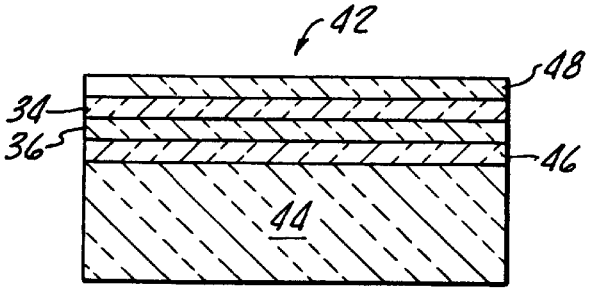
Figure 4:
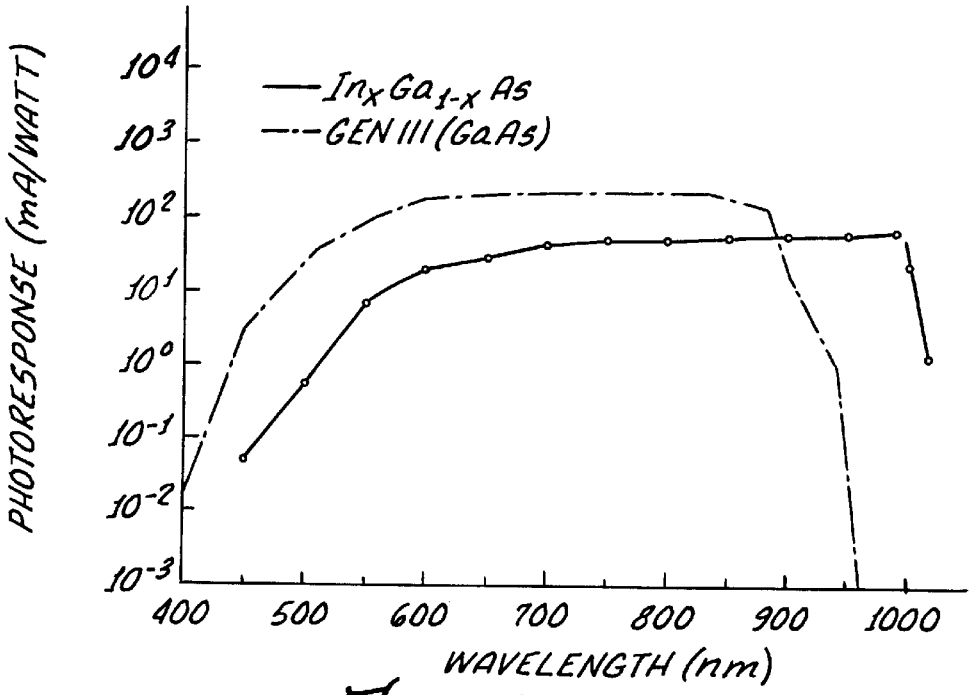

Construction and evaluation of photocathodes according to this invention has lead the inventors to believe that a usable range of values for photocathodes having desirably high white-light and 980 nm sensitivities may be achieved if the percentage of indium in the composition of the active layer 36 (i.e., in the material $In_xGa_{1-x}As$) varies in a range extending from about 9.5% to about 15%. More preferably, the indium percentage in the composition of the active layer 36 is controlled to be in the range of from about 11% to about 14%. Most preferably, the indium percentage in the active layer 36 is controlled to be in the range from 12% to 13%. Viewing FIG. 4 for an indication of the spectral response performance of a photocathode embodying the present invention, it is seen that such a photocathode achieved a white-light sensitivity of 500$\mu$/lm while maintaining a radiant response of greater than 30 mA/W to light of 980 nm wavelength Turning now to FIG. 5, a manufacturing intermediate product 42 used to make a photocathode assembly 22 as seen in FIG. 3 is depicted. Accordingly, the following description of the structure of the product 42 may also be taken as a description of the method steps used in making this product and the photocathode assembly 22. This manufacturing intermediate product 42 includes a substrate 44, a stop layer 46, active layer 36, window layer 34, and a protective cap layer 48. Preferably, the product 42 is fabricated using manufacturing methods, techniques, and equipment conventionally used in making GEN III image intensifier tubes. Accordingly, much of what is seen in FIG. 5 will be familiar to those ordinarily skilled, although the constituent percentages of the structures depicted differ from the conventional The substrate 44 is preferably a wafer of gallium arsenide (GaAs) single crystal material having a low density of crystalline defects. Other types of substrates could be used, but the substrate 44 serves as a base upon which the layers 34, 36, 46, and 48 are grown epitaxially (not recited in the order of their growth on this substrate). Conventional fabrication processes such as MOCVD, MBE, and MOMBE, which are conventional both to the semiconductor circuit industry and to the art of photocathodes, may be used to form the layers on substrate 44. First, the stop layer is formed of aluminum gallium arsenide (AlGaAs) On this stop layer, the active layer 36 is formed, followed by window layer 34. Both the active layer 36 and window layer 34 are doped during formation with a P-type impurity (such as zinc) in order to provide electron mobility in these layers and a reduced work function for electron escape from the active layer 36 into the vacuum free-space environment inside of tube 14. Preferably, doping levels of from about $1\times10^{19}$ to about $9\times10^{19}$ atoms/cm$^3$ is used in the layers 34 and 36, and these doping levels need not be the same in each of these layers Finally, the cap layer 48 is grown on the active layer 36. This cap layer may be formed of gallium arsenide, for example, and provides for protection of active layer 36 during cool down and subsequent transport of the manufacturing intermediate product 42 (i.e., which transport may include exposure to ambient atmospheric conditions) until further manufacturing steps complete its transition to a photocathode assembly as seen in FIG. 3 and subsequent sealing incorporation into an image intensifier tube.

As those ordinarily skilled will know, after the cap layer is removed and coating 32 applied, the layers 34, 36, 44, and 46 are thermally bonded to the face plate 28 (i.e., by thermal bonding of the layer 32 which serves as a thermal bonding layer also. Next, the stop layer 46 serves to prevent an etch operation which is used to remove the substrate 44 from etching into the active layer of the photocathode. Next, the stop layer 46 is selectively etched off, the electrode 40 is applied using standard thin-film techniques, the surface of active layer 36 is cleaned to remove oxides and moisture, and the photocathode assembly is activated using evaporation of cesium and oxygen gas onto the active layer 36.

While the present invention has been depicted, described, and is defined by reference to particularly preferred embodiments of the invention, such reference does not imply a limitation on the invention, and no such limitation is to be inferred. The invention is capable of considerable modification, alteration, and equivalents in form and function, as will occur to those ordinarily skilled in the pertinent arts. The depicted and described preferred embodiments of the invention are exemplary only, and are not exhaustive of the scope of the invention. Consequently, the invention is intended to be limited only by the spirit and scope of the appended claims giving full cognizance to equivalents in all respects.

We claim:

1. A photocathode for receiving photons of light and responsively emitting photoelectrons and being optimized for a quantum response level to light having a wavelength of substantially 980 nm, the photocathode comprising:

a face plate;

a window layer;

an active layer of indium gallium arsenide (InGaAs) in which the percentage of indium compared to the total of indium and gallium together in the active layer is in the range from about 9.5% to about 15%.

2. The photocathode of claim 1 in which the percentage of indium in the active layer in comparison to the total of indium and gallium together in the active layer is in the range from about 11% to about 14%.

3. The photocathode of claim 1 in which the percentage of indium in the active layer in comparison to the total of indium and gallium together in the active layer is in the range from about 12% to about 13%.

4. The photocathode of claim 1 in which one of the window layer and active layer includes a P-type dopant.

5. The photocathode of claim 1 in which said P-type dopant is present in said one layer at a concentration substantially in the range from about $1\times10^{19}$ to about $9\times10^{19}$ atoms/cm$^3$.

6. The photocathode of claim 1 in which said window layer comprises aluminum gallium arsenide material.

7. A photocathode for receiving photons of light and responsively emitting photoelectrons while being optimized for a desirably high level of quantum response to light having a wavelength of substantially 980 nm, the photocathode comprising:

a face plate;

a window layer of aluminum gallium arsenide on said face plate;

an active layer of indium gallium arsenide (InGaAs) in which the percentage of indium compared to the total of indium and gallium together in the active layer is substantially 12.55%.

8. The photocathode of claim 7 wherein said active layer further defines an electron-emitting surface, said electron-emitting surface including a surface layer portion including both cesium and oxygen deposited onto said InGaAs active layer.

9. A device having body defining a vacuum envelope and including a photocathode according to claim 7, said device further providing an output in response to a flux of infrared light.

10. A method of making a photocathode which is responsive to photons of infrared light to emit photoelectrons, said method comprising the steps of:

providing a face plate;

providing a window layer on said face plate;

attaching an active layer of indium gallium arsenide on said window layer; and providing said active layer with a percentage of indium of substantially 12 to 13 percent in comparison to the total of indium and gallium in said active layer.

11. The method of making a photocathode according to claim 10 further including the step of providing in one of the window layer and the active layer a P-type dopant.

12. The method of claim 11 further including the step of providing said P-type dopant in said one layer at a concentration in the range from about $1\times10^{19}$ to about $9\times10^{19}$ atoms/cm$^3$.

13. The method of claim 10 further including the step of including aluminum gallium arsenide material in said window layer.

14. A photocathode manufacturing intermediate article comprising:

a substrate layer;

a stop layer on said substrate layer;

an active layer carried by said substrate layer, said active layer including indium gallium arsenide (InGaAs) material responsive to photons of light in a certain wavelength band to release photoelectrons; in which the percentage of indium compared to the total of indium gallium together in the InGaAs material of said active layer is in the range from about 9.5% to about 15%.

15. The photocathode manufacturing intermediate article of claim 14 further including a window layer carried by said active layer.

16. The photocathode manufacturing intermediate article of claim 15 further including an environmentally protective cap layer carried by said window layer.

17. The photocathode manufacturing intermediate article of claim 14 in which the percentage of indium in the active layer in comparison to the total of indium and gallium together in the active layer is in the range from about 11% to about 14%.

18. The photocathode manufacturing intermediate article of claim 14 in which the percentage of indium in the active layer in comparison to the total of indium and gallium together in the active layer is in the range from about 12% to about 13%.

19. The photocathode manufacturing intermediate article of claim 14 in which one of said window layer and said active layer includes a P-type dopant.

20. The photocathode manufacturing intermediate article of claim 19 in which said P-type dopant is present in said one layer at a concentration substantially in the range from about $1\times10^{19}$ to about $9\times10^{19}$ atoms/cm$^3$.

21. The photocathode manufacturing intermediate article of claim 15 in which said window layer comprises aluminum gallium arsenide material.

22. A night vision device having an objective lens, an image intensifier tubes and an eyepiece lens, the image intensifier tube having a photocathode especially responsive to light of substantially 980 nm wavelength, said photocathode comprising:

a face plate;

a window layer;

an active layer of indium gallium arsenide (InGaAs) in which the percentage of indium compared to the total of indium and gallium together in the active layer is in the range from about 9.5% to about 15%.

23. The night vision device of claim 22 in which the percentage of indium in the active layer in comparison to the total of indium and gallium together in the active layer is in the range from about 11% to about 14%.

24. The night vision device of claim 23 in which the percentage of indium in the active layer in comparison to the total of indium and gallium together in the active layer is in the range from about 12% to about 13%.

25. The night vision device of claim 23 in which one of the window layer and active layer includes a P-type dopant.

26. The night vision device of claim 23 in which said P-type dopant is present in said one layer at a concentration substantially in the range from about $1\times10^{19}$ to about $9\times10^{19}$ atoms/$cm^3$.

27. The night vision device of claim 23 in which said window layer comprises aluminum gallium arsenide material.

28. An image intensifier tube having a body with transparent face plate and image output window portions, a photocathode disposed behind the face plate window portion, said photocathode liberating photoelectrons in response to photons of light, a microchannel plate receiving the photoelectrons and responsively providing a shower of secondary emission electrons, and an output electrode receiving the shower of secondary emission electrons to provide an output image via said output window, said photocathode being especially responsive to light of substantially 980 nm, and said photocathode comprising:

a window layer carried by the face plate of the image intensifier tube;

an active layer of indium gallium arsenide (InGaAs), in which the percentage of indium compared to the total of indium and gallium together in the active layer is in the range from about 9.5% to about 15%.

29. The image intensifier tube of claim 28 in which said window layer comprises aluminum gallium arsenide material.

30. The image intensifier tube of claim 29 in which said active layer comprises InGaAs material in which the percentage of indium compared to the total of indium and gallium together in the active layer is substantially 12.55%.

* * * * *